US007281497B2

(12) United States Patent
Le Mer et al.

(10) Patent No.: US 7,281,497 B2
(45) Date of Patent: Oct. 16, 2007

(54) CONDENSATION HEAT EXCHANGER WITH PLASTIC CASING

(75) Inventors: Joseph Le Mer, Morlaix (FR); Rocco Giannoni, Milan (IT)

(73) Assignees: Societe d'Etude et de Realisation Mecaniques Engeneering en Technologies Avancees, Morlaix (FR); Joseph LeMer, Morlaix (FR)

( * ) Notice: Subject to any disclaimer, the term of this patent is extended or adjusted under 35 U.S.C. 154(b) by 38 days.

(21) Appl. No.: 10/531,290

(22) PCT Filed: Oct. 10, 2003

(86) PCT No.: PCT/FR03/02984

§ 371 (c)(1),
(2), (4) Date: Oct. 4, 2005

(87) PCT Pub. No.: WO2004/036121

PCT Pub. Date: Apr. 29, 2004

(65) Prior Publication Data

US 2006/0196450 A1 Sep. 7, 2006

(30) Foreign Application Priority Data

Oct. 16, 2002 (FR) ..... 02 12848
Jan. 24, 2003 (FR) ..... 03 00775

(51) Int. Cl.
*F22B 1/02* (2006.01)

(52) U.S. Cl. ..... 122/31.2; 122/18.1; 122/19.1

(58) Field of Classification Search ..... 122/18.1, 122/19.1, 31.1, 31.2, 32, 248, 266, 267; 165/163
See application file for complete search history.

(56) References Cited

U.S. PATENT DOCUMENTS

| | | | | |
|---|---|---|---|---|
| 5,311,843 | A * | 5/1994 | Stuart | 122/248 |
| 5,516,278 | A | 5/1996 | Morrison | |
| 5,546,760 | A * | 8/1996 | Cook et al. | 62/497 |
| 5,687,678 | A * | 11/1997 | Suchomel et al. | 122/250 R |
| 5,713,310 | A * | 2/1998 | Lemke | 122/248 |
| 6,152,086 | A * | 11/2000 | Brouwer et al. | 122/249 |
| 2001/0031440 | A1 | 10/2001 | Fullemann et al. | |

FOREIGN PATENT DOCUMENTS

| | | |
|---|---|---|
| DE | 100 51 219 | 2/2002 |
| EP | 1 039 246 | 9/2000 |

* cited by examiner

*Primary Examiner*—Gregory A. Wilson
(74) *Attorney, Agent, or Firm*—Foley & Lardner LLP

(57) ABSTRACT

The invention concerns a heat exchanger comprising at least one helically bound bundle of tubes, whereof the thermally conductive wall has a flattened and oval cross-section, whereof the main axis is perpendicular to that (X-X') of the helix, while the width of the interstice separating two adjacent turns is small and constant, said bundle being fixedly mounted inside a casing (1) fitted with a pipe for evacuating gases generated by a burner (6), means being provided for circulating cold water inside said bundle, said exchanger being further designed so that the hot gases pass radially through the bundle via the interstices of the turns. Said exchanger is characterized in that the casing is made of heat-resistant plastic material and means are provided for ensuring mechanical containment of the beam in the axial direction, and for damping the thrust loads resulting from the fluid internal pressure, preventing their being transmitted to the casing. The inventive condensation heat exchanger is particularly designed for domestic use and is inexpensive to produce.

19 Claims, 12 Drawing Sheets

CONDENSATION HEAT EXCHANGER WITH PLASTIC CASING

The present invention relates to a condensation heat exchanger associated—directly or indirectly—with a burner, particularly a gas or fuel burner.

This exchanger is intended in particular to equip a gas boiler for domestic applications, with the aim of supplying a central heating circuit and/or providing water for sanitary use.

More specifically, the heat exchanger which forms the subject of the invention is of the type comprising a casing which delimits an enclosure inside which is housed at least one bundle made up of a tube or tubes of flattened cross section, of the kind described in document EP-B-0 678 186, to which reference may be made as required.

Document EP-B-0 678 186 describes a heat exchanger element which consists of a tube made of highly thermally conductive material, in which a heat-transfer fluid, for example water to be heated up, is intended to circulate. This tube is helically wound and has a flattened oval cross section whose major axis is substantially perpendicular to the axis of the helix, and each turn of the tube has flat faces which are separated from the faces of the adjacent turn by a gap of constant width, this width being substantially smaller than the thickness of said cross section, the spacing between two neighboring turns being additionally calibrated by means of spacers, these consisting of bosses formed in the wall of the tube.

This document also describes heat exchangers containing a number of elements, such as described above, which are arranged in different ways in the various embodiments set forth.

An exchanger element thus designed is capable of providing very efficient heat exchange between, on the one hand, very hot gases which may be generated directly by a burner mounted in the enclosure, or come from an external source, and which sweep over the tubular element, and, on the other hand, the fluid to be heated up, such as water, which circulates inside this tubular element.

Specifically, during its passage through the gap between the turns, in an approximately radial direction, the flow of hot gases comes into contact with a relatively large area of the wall of the exchanger element.

The object of the present invention is more particularly to provide a condensation heat exchanger of the general type set forth above, the heat exchange elements of which are bundles of flat tubes such as those disclosed in EP-B-0 678 186 mentioned above.

The casing making up the known condensation appliances of the kind set forth above is, just like the tube or tubes, made of metal, generally stainless steel.

Metal, in particular stainless steel, is suitable for use because it provides both mechanical resistance to the stresses due to expansions occurring within the winding made up of a tube or tubes and chemically to the corrosion emanating from the flue gases (burnt gases) and the condensates.

For illustration purposes, it should be pointed out in this regard that the pressure of the fluid to be heated up, particularly water, inside the tube (or tubes) during use may be relatively high, around 2.5 to 3.5 bar, that is $2.5 \cdot 10^5$ to $3.5 \cdot 10^5$ Pa.

For safety reasons, the tubular bundle is advantageously designed to be able to withstand a pressure of $4.5 \cdot 10^5$ Pa.

The initially flat lateral walls of the tubes have a tendency to bulge, the amplitude of the deformation being an increasing function of the value of the internal pressure.

This deformation is propagated axially, from one wall to the adjacent wall, by way of spacer-forming bosses which separate them.

For illustrative purposes, taking a winding of four juxtaposed tubes having a wall thickness of 0.6 mm, the axial dimension of which is initially 128 mm, this dimension, subsequent to the deformation of the tubes, will be increased to a value of around 129.2 mm for a pressure of 2 bar and of around 129.8 mm for a pressure of 3 bar.

The total elongation is proportional to the number of windings mounted end to end constituting the bundle of the exchanger.

Of course, increasing the wall thickness of the tubes can reduce the amplitude of the deformation. Unfortunately, oversizing the thickness considerably increases the weight of the appliance. Problems also arise if the tubular elements are produced by hydroforming, a process requiring extremely high operating pressures.

To oppose the elongation and withstand the axial thrusts resulting from the internal pressure of the fluid circulating in the bundle, the solution used up until now is to adopt a metal casing (acting as a support at the two ends of the bundle), the thickness and mechanical strength of which are chosen so that they prevent the axial expansion of said bundle under the effect of the internal pressure, or at least restrict it to an acceptable amplitude compatible with the elastic deformation limit of the casing.

This type of exchanger is satisfactory on the technical level, in particular on the performance level.

However, it is relatively heavy, which may create difficulties for the operator when it is being transported and handled during its installation, and its cost price is relatively high because, in order to withstand the mechanical stresses and chemical attacks caused by the flue gases and the condensates, it is necessary to make use of a casing made of high quality metal, such as stainless steel.

The objective on which the present invention is based is to significantly reduce the weight and the cost price of the appliance, by proposing that it be equipped with a casing which, although made of a substantially less noble and less costly material, in this instance plastic, does not present any problems either in terms of chemical resistance or mechanical strength with regard to the axial expansion problem referred to above.

Another objective of the present invention is, in a variant, to ensure that the plastic casing is optimally insulated from the heat generated by the burnt gases passing through the turns of the winding and, correspondingly, to substantially lower the level of the temperatures to which the casing is exposed, this being achieved by employing simple, lightweight and inexpensive means, in this instance a shroud performing the function of a heat shield.

The condensation heat exchanger which forms the subject of the invention is intended to be associated with a gas or fuel burner.

It comprises at least one bundle of tubes, which bundle consists of one tube, or a group of tubes arranged end to end, forming a helical winding, in which the wall of the tube or tubes is made of a highly thermally conductive material and has a flattened oval cross section whose major axis is perpendicular, or approximately perpendicular, to that of the helix, while the width of the gap separating two adjacent turns is constant and appreciably smaller than the thickness of said cross section, this bundle being mounted fixedly inside a gas-impermeable casing, means being provided for circulating a fluid to be heated up, in particular cold water, inside the tube or tubes constituting said bundle, this casing having a sleeve for the discharge of the burnt gases, this exchanger thus being arranged such that the hot gases generated by the burner pass radially, or approximately radially, through said bundle via the gaps separating its turns.

According to the invention:

on the one hand, said casing is made of heat-resistant plastic, and on the other hand, the exchanger contains means for mechanically retaining said bundle in its axial direction, these means being able to absorb the thrust loads resulting from the internal pressure of the fluid which circulates therein and which tends to deform the walls thereof, while preventing these loads from being transmitted to the casing.

There is thus a dissociation of the two tasks assigned to the casing up until now, namely acting as an enclosure for the circulation and discharge of the hot gases, and also for the collection and discharge of the condensates, and, on the other hand, ensuring the mechanical stability of the bundle of tubes.

Furthermore, according to a certain number of characteristics which are advantageous but do not limit the invention:

the exchanger contains a temperature probe borne by said casing which is able to shut down the burner when the temperature prevailing inside the casing, in the vicinity of this probe, exceeds a predetermined threshold;

said retaining means comprise a set of ties which extend outside the bundle, parallel to the axis of the helix, and whose ends are fixed to bearing elements pressing against the two opposed faces of the bundle;

the bearing element situated at one of the ends of the set of ties is a thin plate, for example in the form of a disk, which is cut out in its central part and consequently has an annular shape;

said plate serves as a facing which partially closes off an open face of the casing and is fastened to the latter at its periphery, for example by crimping;

the end portions of the ties pass through said facing in such a way as to project slightly outward, and these end portions are threaded such that they allow a door to be mounted removably against the facing by means of nuts;

said door is fixed to the burner;

there are four ties arranged substantially in a square, and the bearing elements situated on the opposite side to said facing consist of a pair of arcuate or bent straps configured to follow the contour of the bundle as closely as possible and pressing against two diametrically opposed regions thereof, each strap being fastened to a pair of neighboring ties;

the plastic constituting the casing is a composite material based on glass-fiber-reinforced or glass-flake-reinforced resin;

said resin is a compound of polyphenylene oxide, polystyrene and polypropylene;

the exchanger comprises two bundles of coaxial tubes situated end to end and connected to one another, one of which serves as a primary exchanger and the other as a secondary exchanger, a deflecting member being sandwiched between these two bundles and thus arranged such that the hot gases generated by the burner pass first through the primary exchanger, passing through the gaps separating its turns from the inside to the outside, and then through the secondary exchanger, passing through the gaps separating its turns from the outside to the inside;

the deflector is fixed to said bundles of tubes;

since the burner is mounted inside the bundle which serves as primary exchanger, said deflector has a discoid shape and is fixed to the end of the burner, this deflector being equipped at its periphery with a thermally insulating seal which is pressed against the inside of the bundle;

said casing consists of two molded half-shells brought together and secured to one another, for example by welding;

the exchanger contains a shroud arranged outside the bundle made up of a tube or tubes and inside said plastic casing, this shroud acting as a heat shield which is able to insulate this casing from the heat emitted by the burnt gases;

this shroud is made from thin stainless steel sheet;

the shroud is applied to the internal surface of the plastic casing but is kept at a certain distance from the latter, for example by means of a series of bosses stamped into the wall of the shroud;

the shroud consists of two complementary rounded parts brought together so as to form an annular casing fitting against the internal surface of said plastic casing;

the mutually facing edges of said rounded parts have a row of approximately semicircular or semioval notches which are able to tightly enclose the rectilinear end portions of the tube or tubes constituting the winding when these rounded parts are brought together.

Other characteristics and advantages of the invention will become apparent from the description and the appended drawings which, purely by way of non-limiting example, represent possible embodiments thereof.

Figure 1:
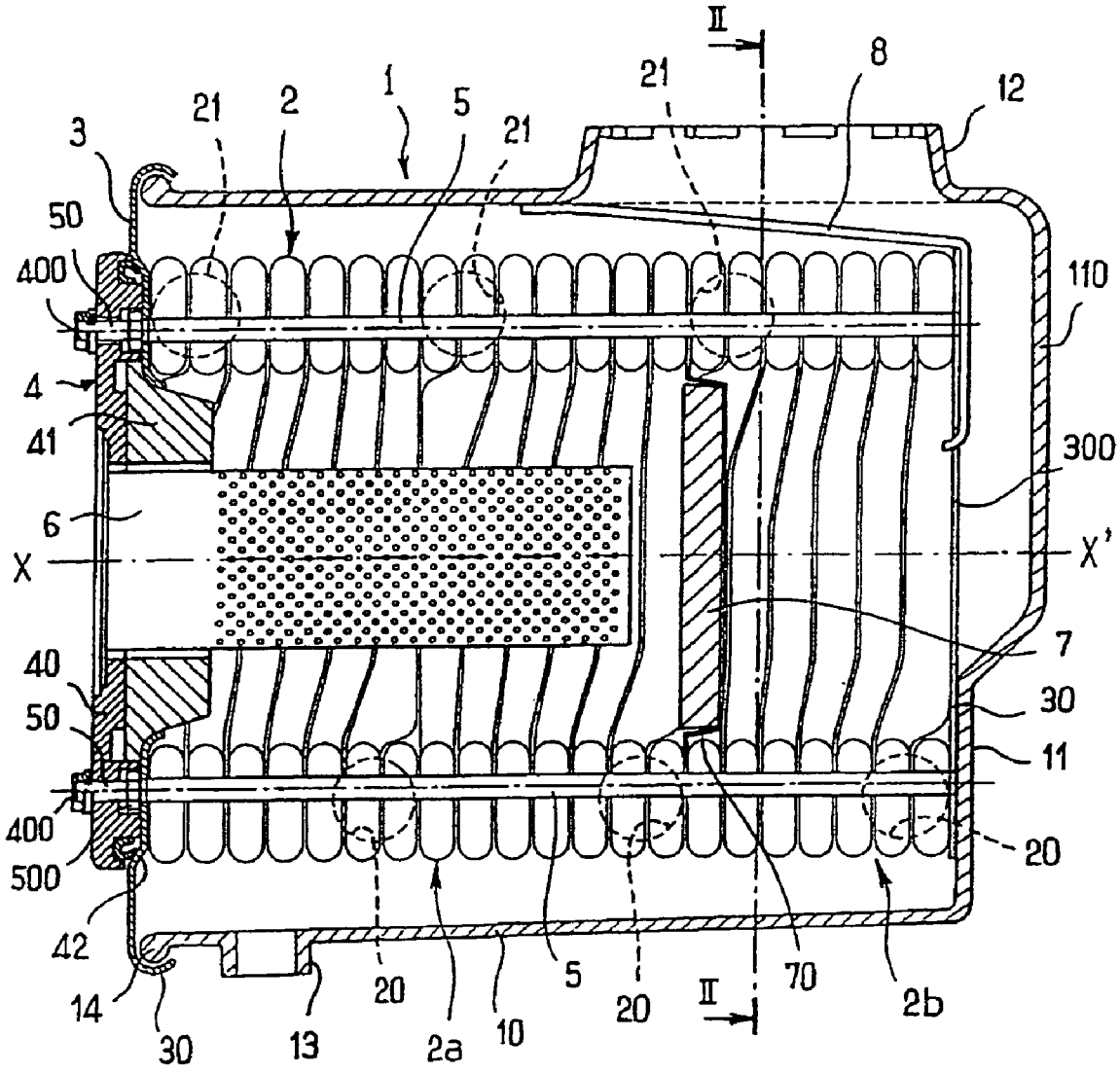
FIG. 1 is a schematic front view of a first embodiment of the invention, cut by the vertical plane referenced I-I in FIG. 2.
Figure 2:
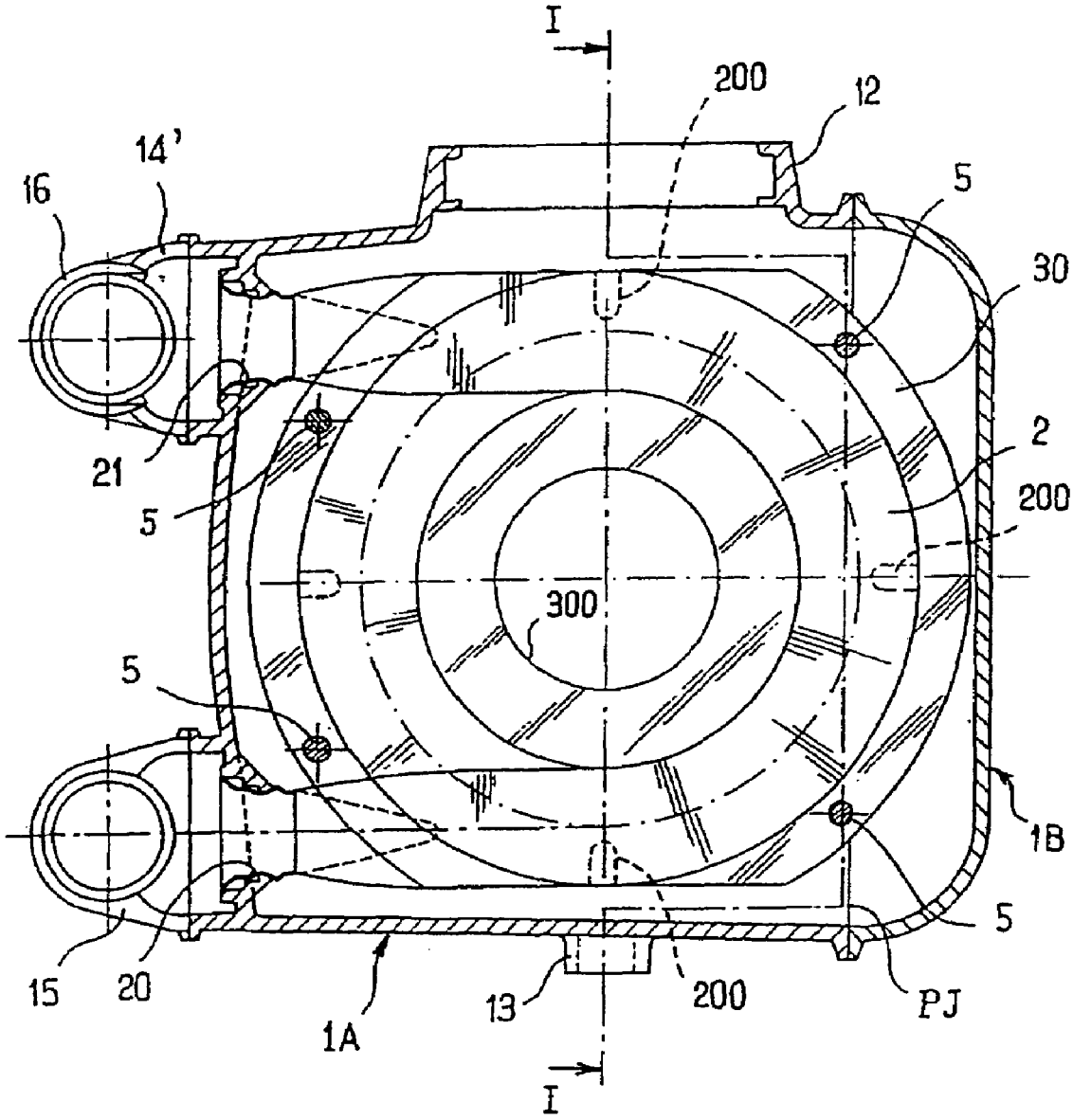
FIG. 2 is a schematic left-side view of the appliance of FIG. 1.
Figure 3:
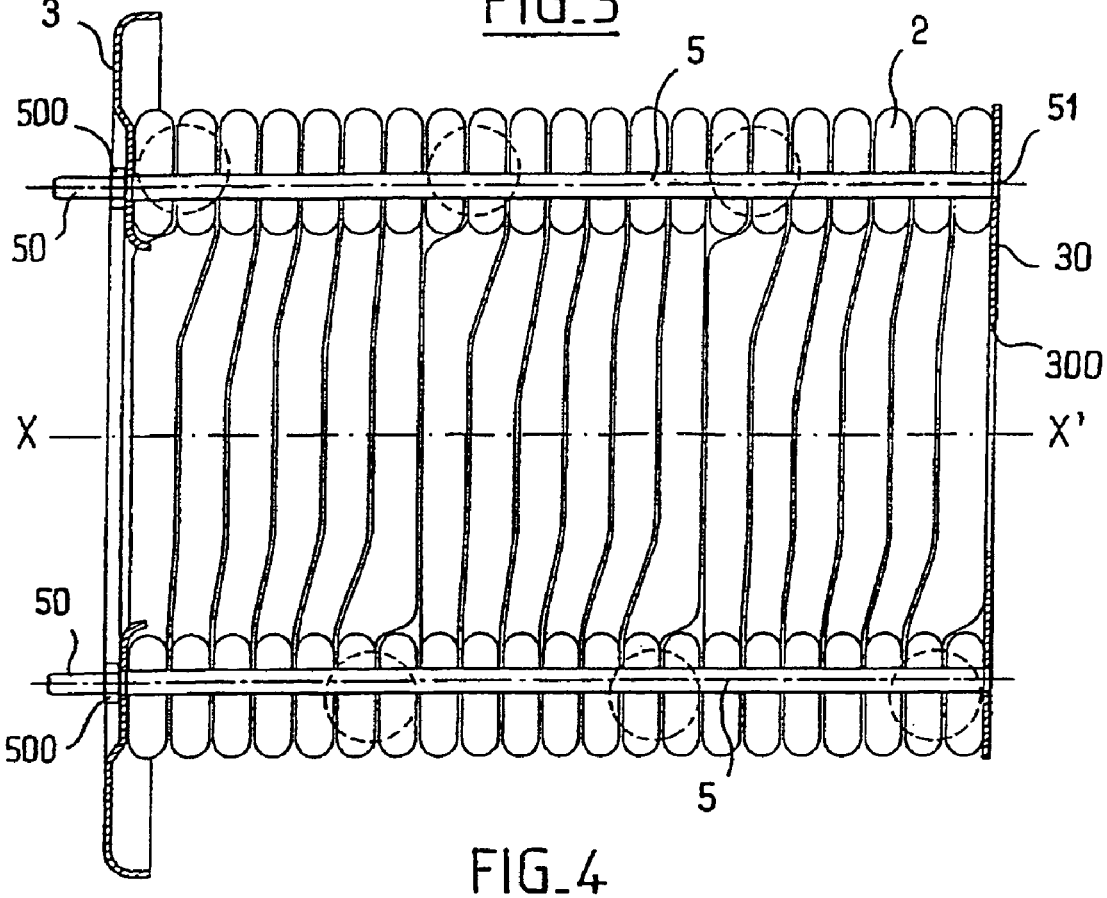
FIGS. 3 and 4 are views similar to FIGS. 1 and 2 respectively, representing the bundle of tubes and its retention means only.
Figure 4:
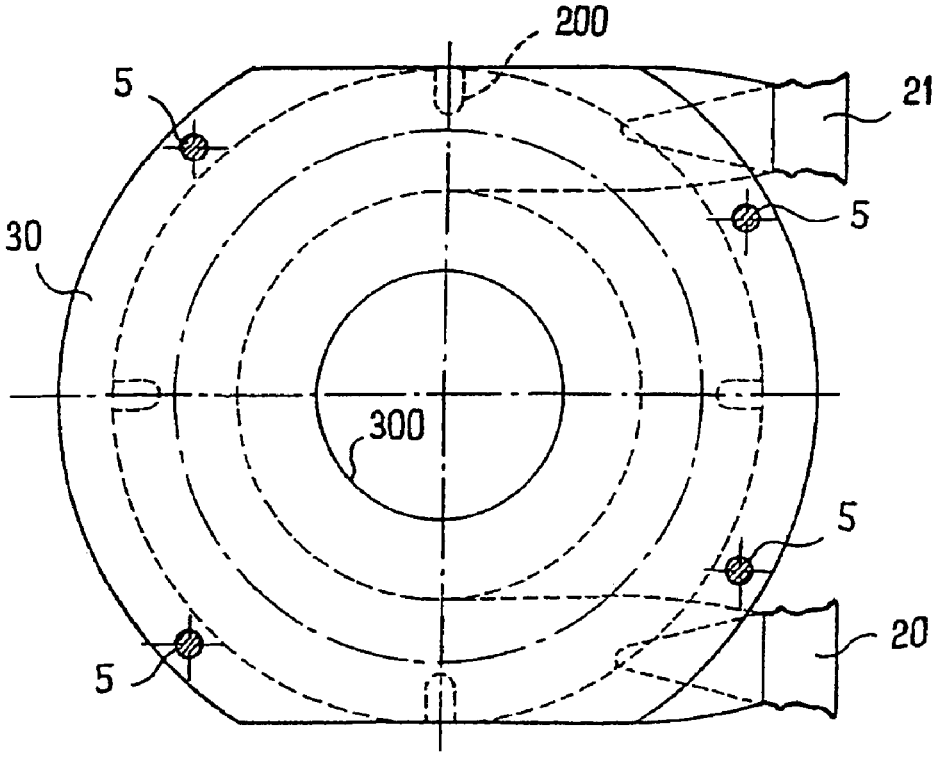
Figure 5:
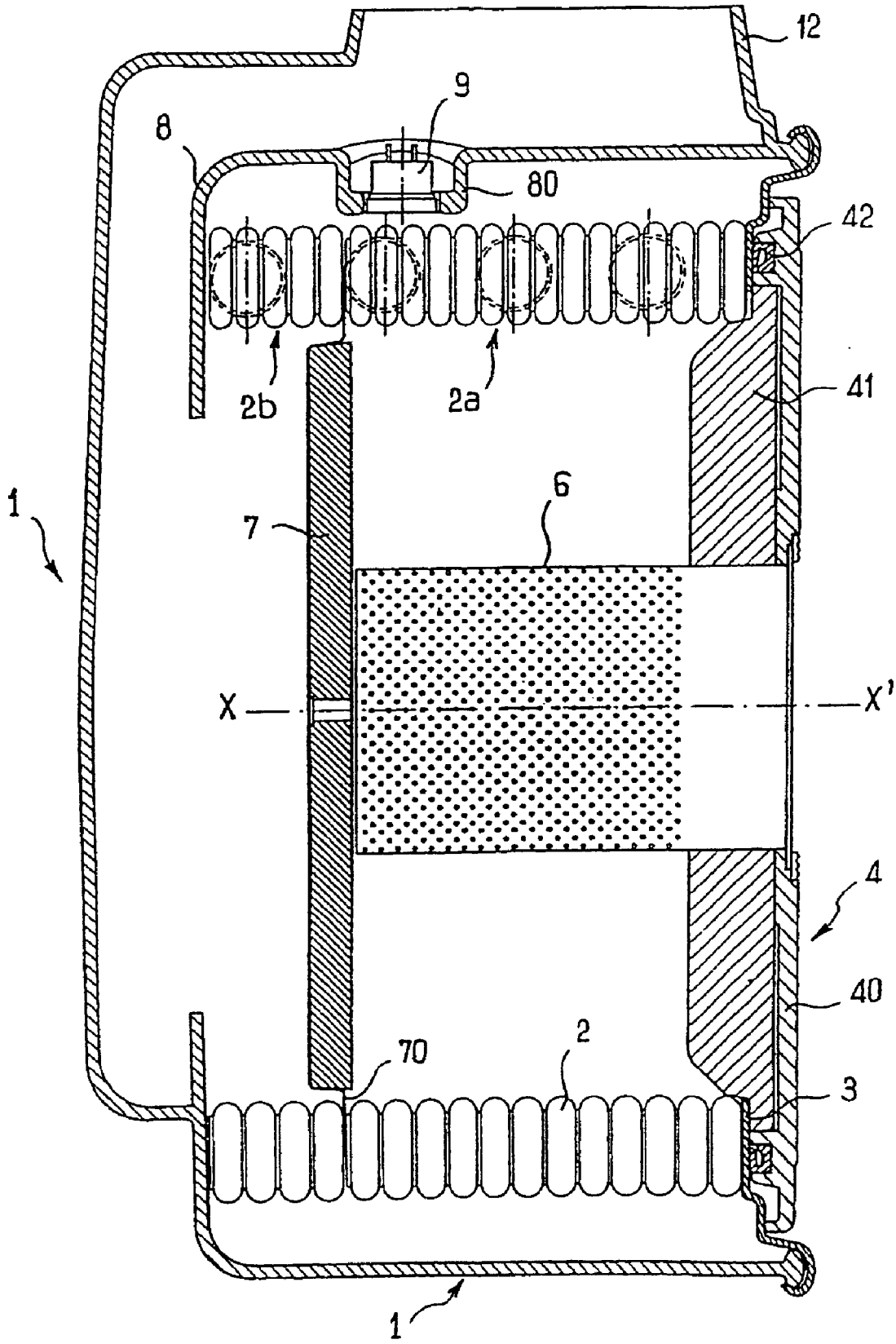
FIG. 5 is a view analogous to FIG. 1, representing a second possible embodiment of the exchanger, the overall axial size of which is smaller.
Figure 7:
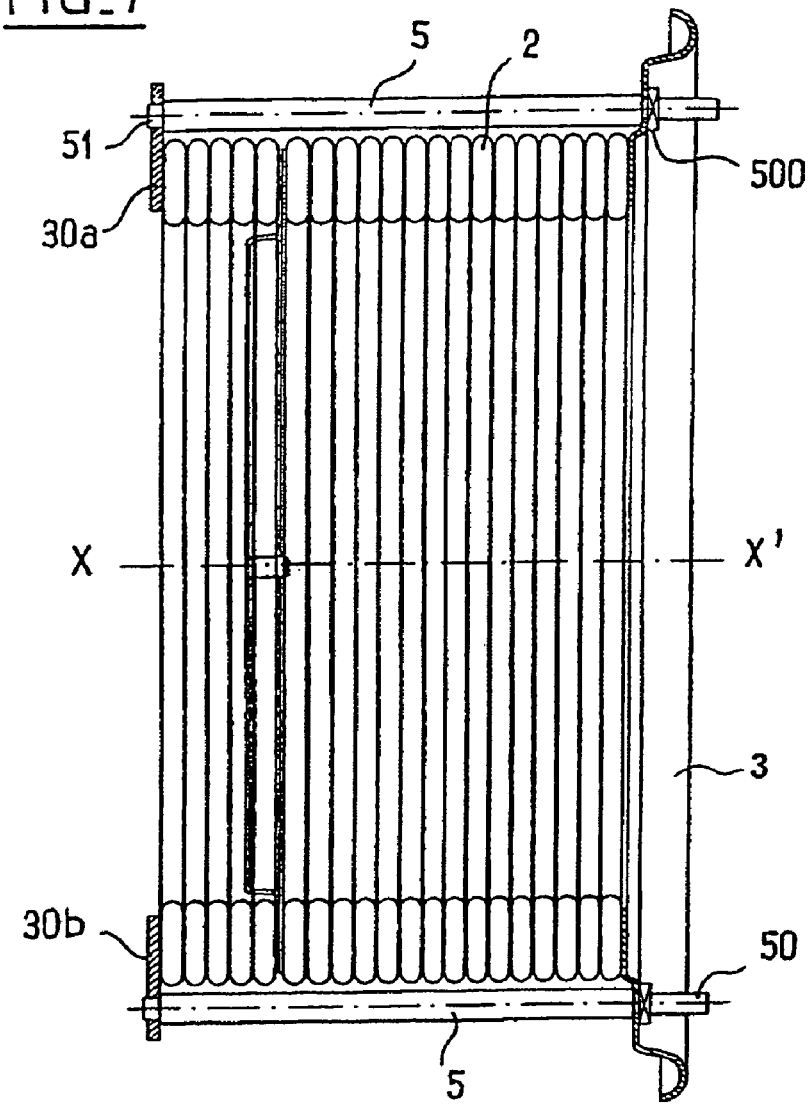
Figure 8:
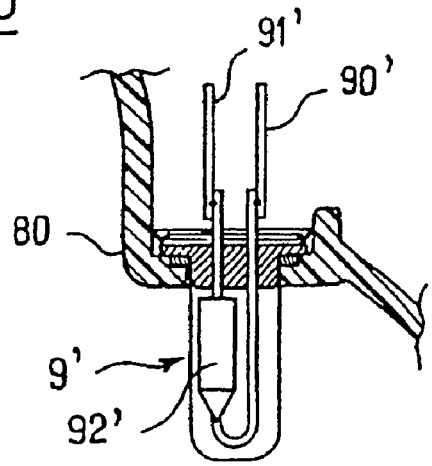
Figure 9:
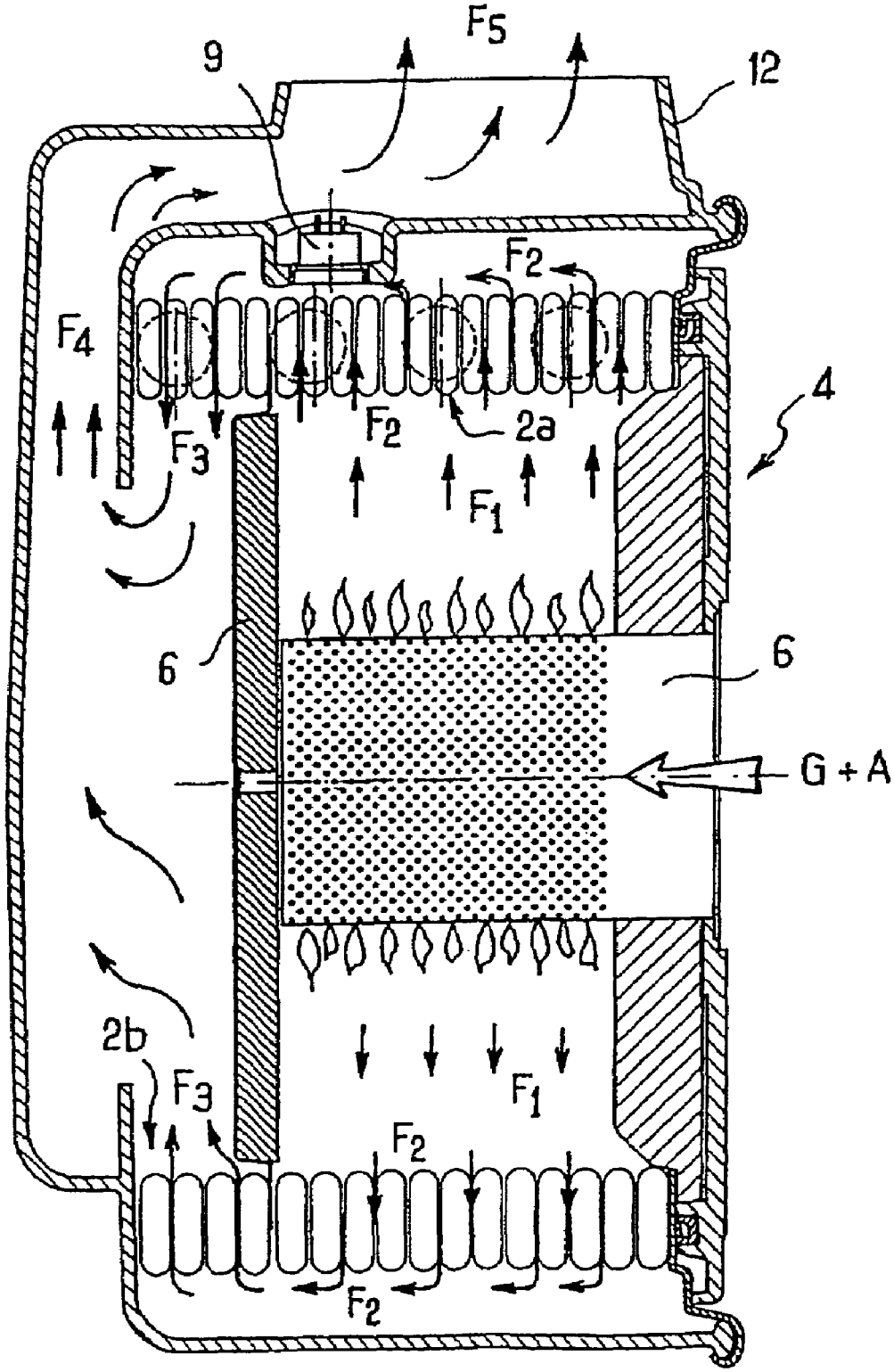
Figure 10:
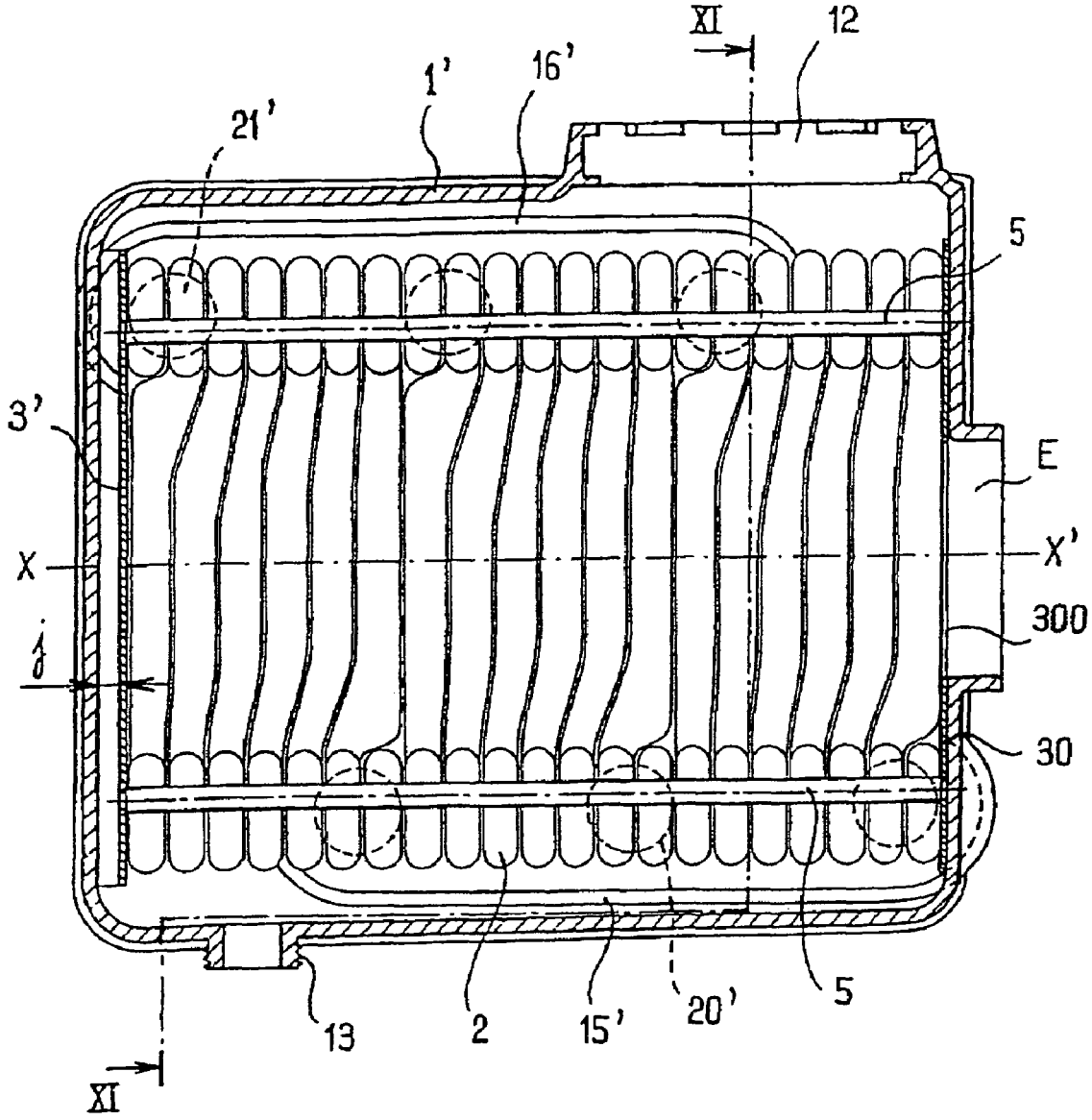
Figure 11:
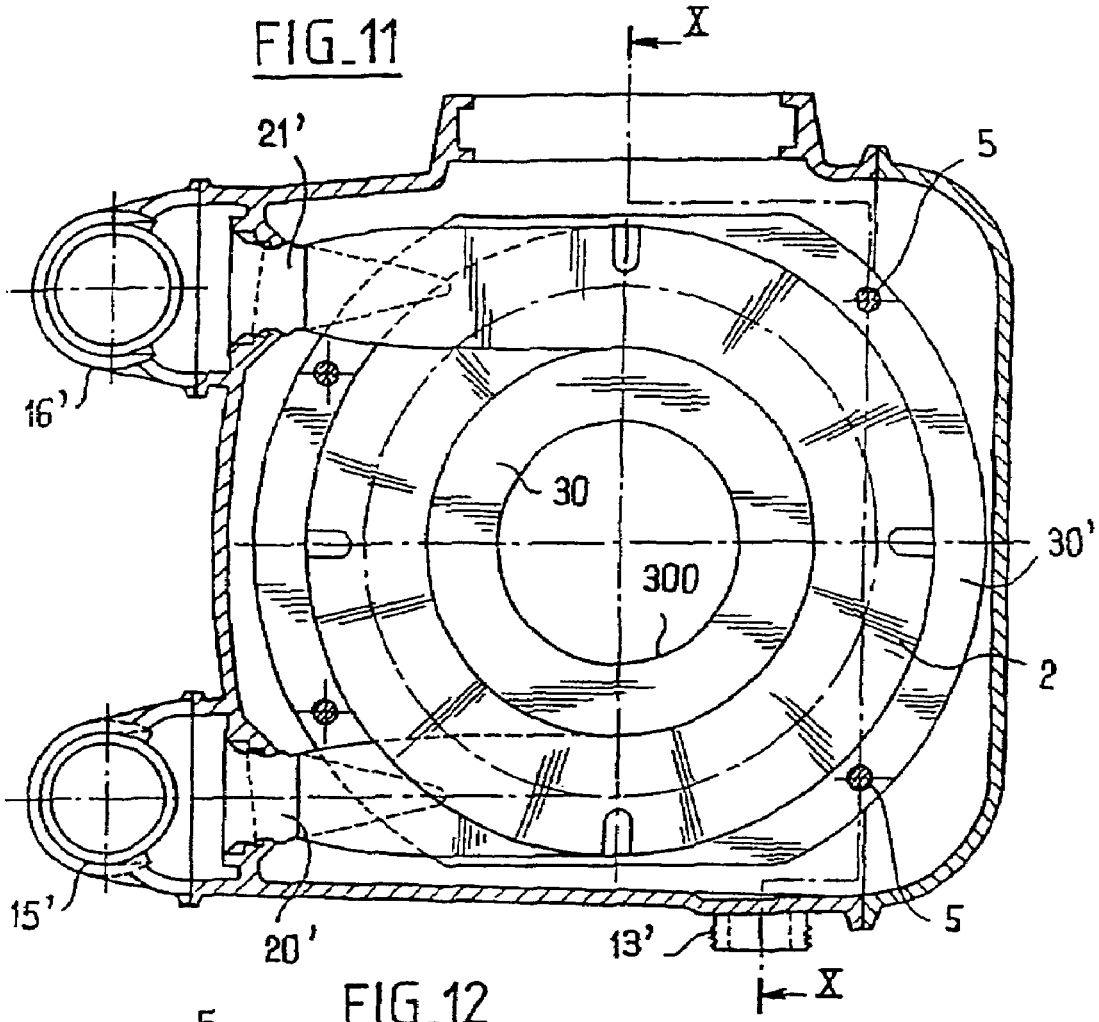
Figure 12:
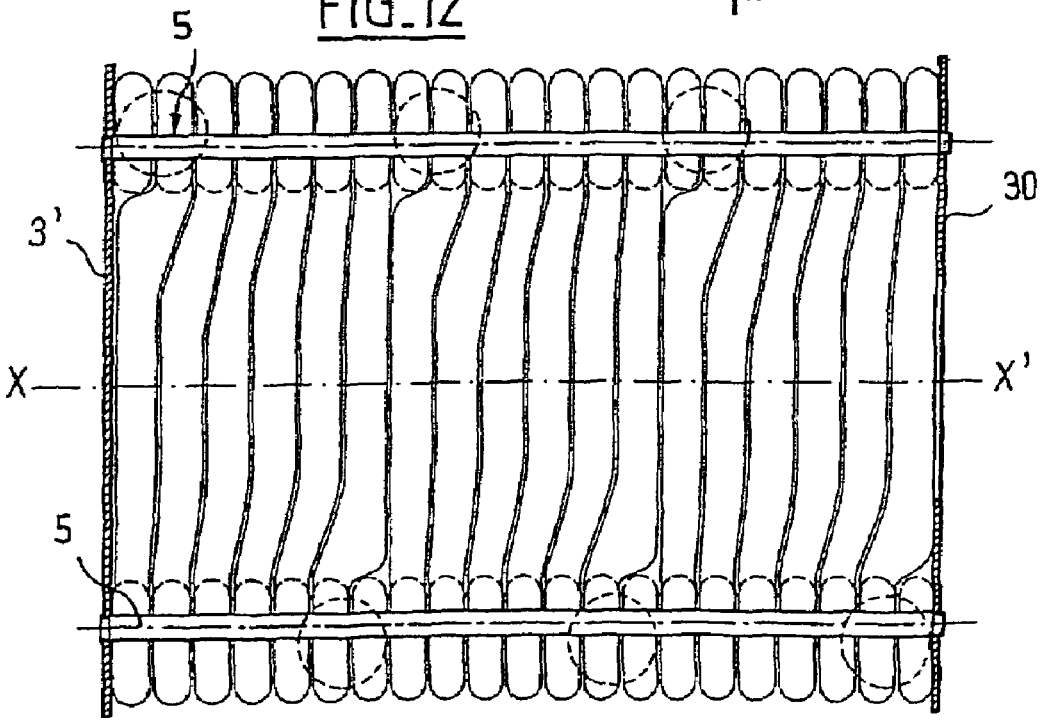
Figure 13:
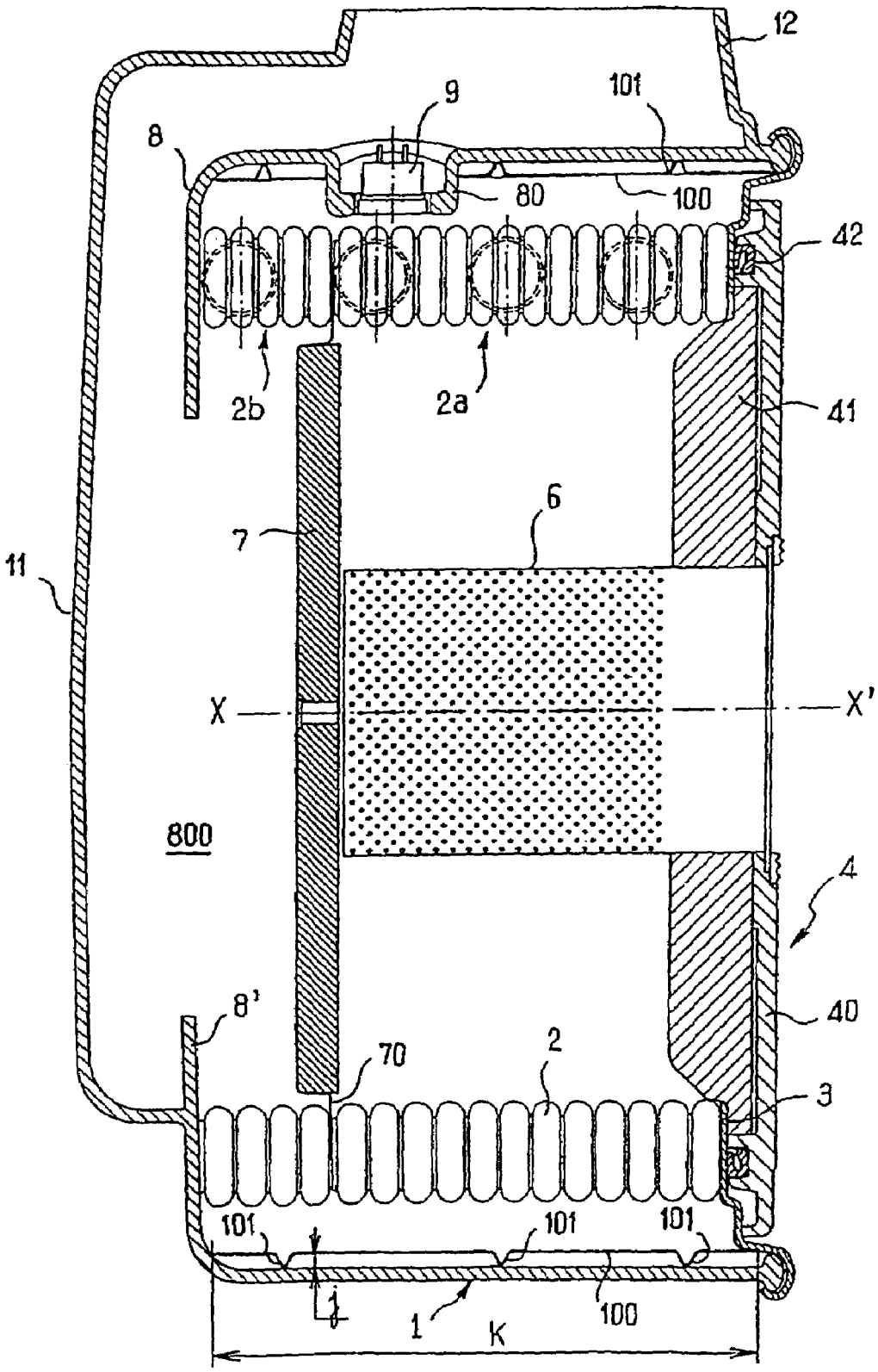
Figure 14:
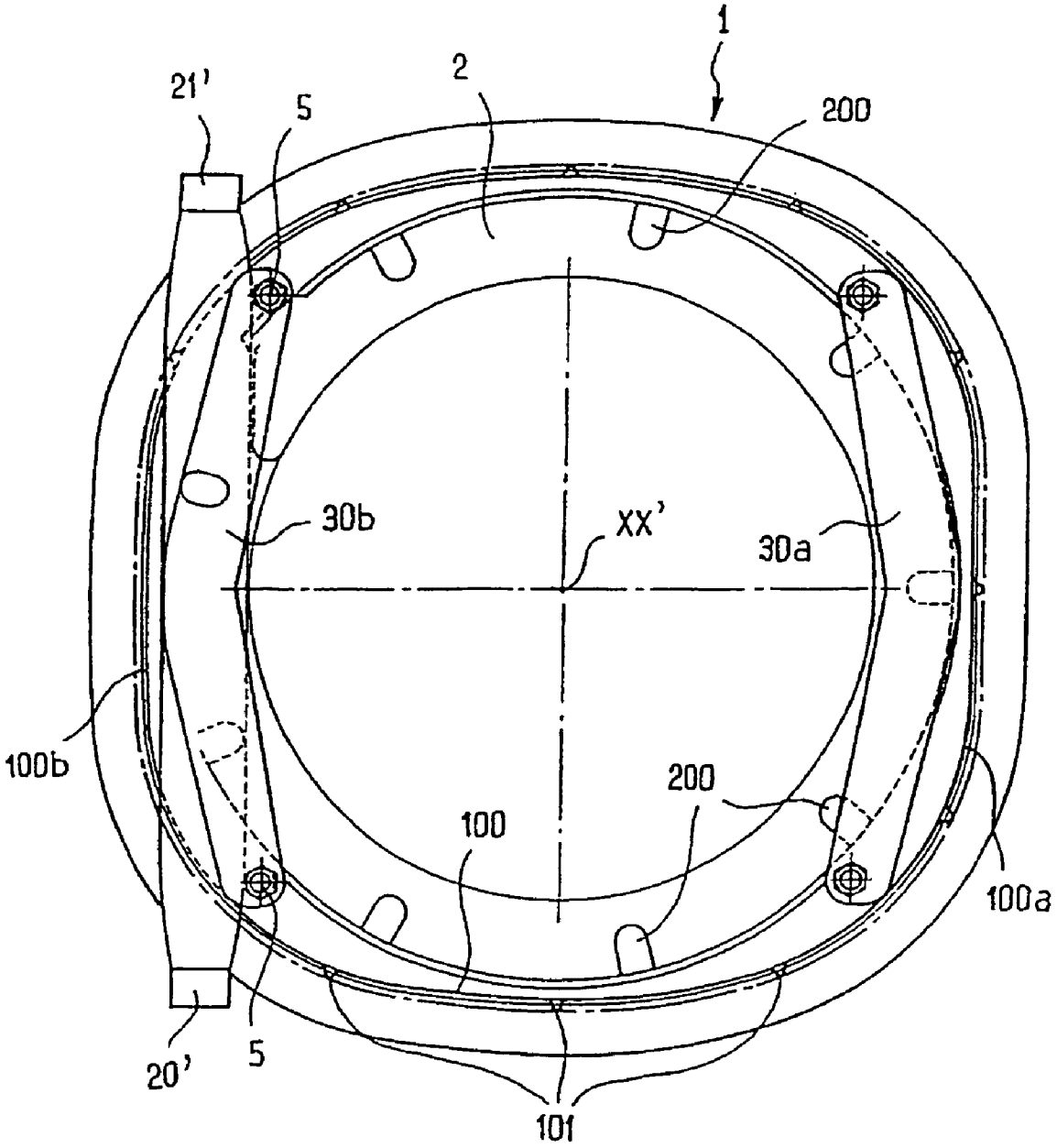

FIG. 7 schematically represents front views of these retaining means;

FIG. 8 is a detail view showing a possible variant of the temperature detector which can be employed, replacing the one illustrated in FIG. 5;

FIG. 9 illustrates the operation of the appliance of FIG. 5;

FIGS. 10, 11 and 12 are views analogous to those of FIGS. 1, 2 and 3, respectively, representing a third embodiment of an exchanger according to the invention, not provided with a burner;

FIGS. 13 and 14 are respective schematic front and side views of an exchanger according to the invention, cut by a vertical plane passing through the axis of the winding, this exchanger being similar to the embodiment of FIG. 5, but containing a shroud performing a heat shield function;

FIGS. 15 and 16 represent, again schematically, the two strip-form elements (not yet rounded) constituting the shroud.

The exchanger represented in FIGS. 1 and 2 contains a shell or casing 1 which delimits an enclosure inside which is fixedly mounted a tubular bundle 2, this consisting of a helical winding, of axis X-X', of a group of tubes arranged end to end and connected in series.

These are tubes of flattened cross section whose large sides are perpendicular to the axis X-X'.

Bosses 200 provided on the large faces of the tubes perform the function of spacers, making it possible to delimit between each turn a gap having a substantially constant, calibrated value.

This winding is intended to be traversed internally by the fluid to be heated up, which is water for example.

In the embodiment illustrated, there are three helical tubular elements brought together and connected in series, in which the fluid to be heated up circulates from left to right.

Manifolds 15, 16, which are fastened to the casing 1, enable the appliance to be connected in the conventional manner to a pipe for feeding the cold fluid, which is to be heated up, and for discharging the hot fluid.

These manifolds also transfer the fluid being circulated from a tubular element to the neighboring winding.

Each tubular element has straight-end portions, that is to say of rectilinear axis, with a progressively variable cross section, of which the emergent end part is circular.

In the example illustrated in FIG. 2, the two end portions are arranged parallel and situated on the same side of the winding.

It may be noted that a similar arrangement is also provided for the third embodiment illustrated in FIGS. 10 and 11.

Figure 6:
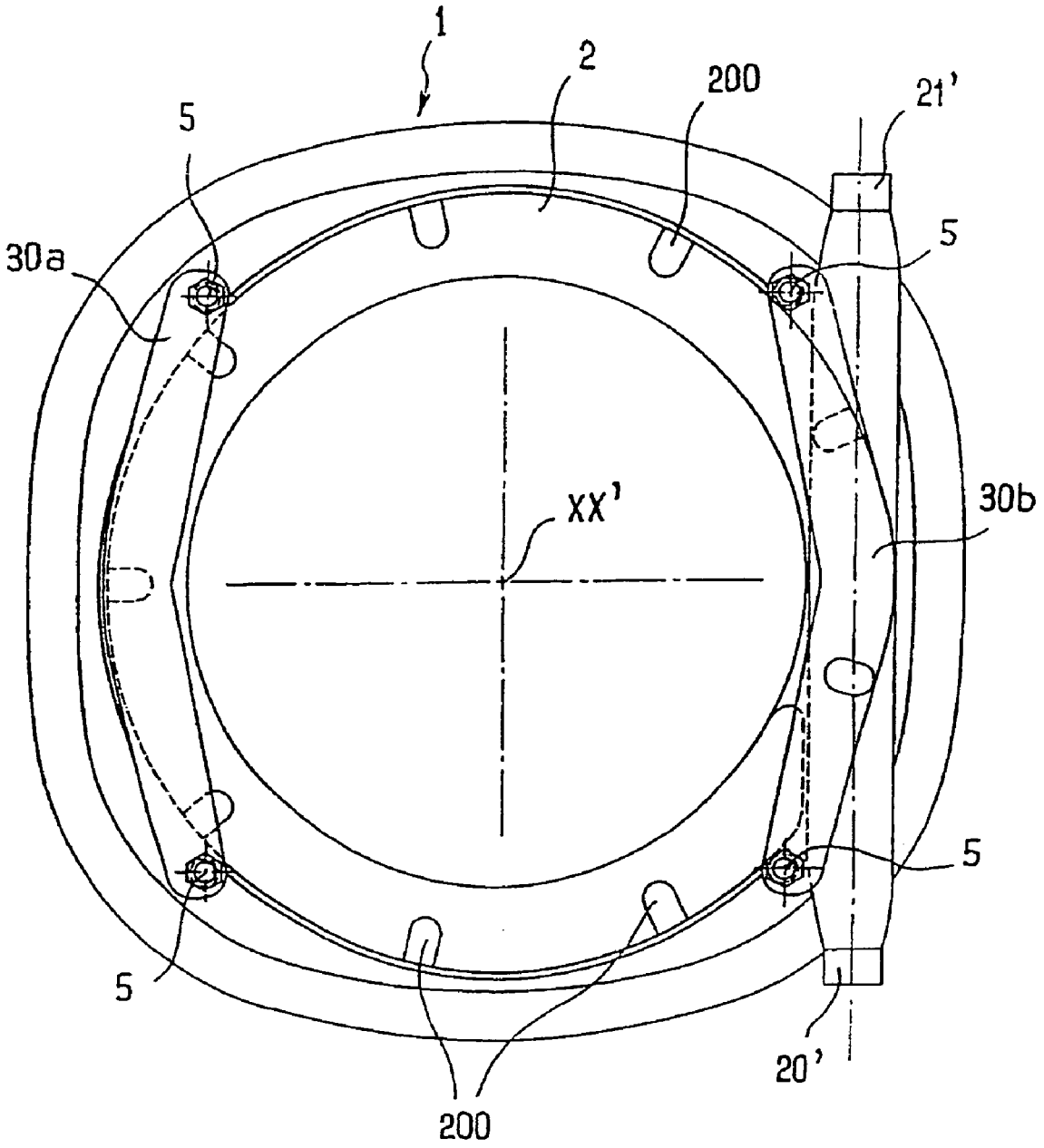
FIG. 6 is a side view of the exchanger of FIG. 5, illustrating the method employed therein to retain the bundle.

By contrast, in the case of the second embodiment of the invention, illustrated in FIGS. 5 and 6, the two end portions of a tubular winding extend in the same plane, their mouths being directed away from one another, in an arrangement according to that illustrated in FIG. 24 of European patent 0 678 186 mentioned already.

The inlet and outlet mouths 20, 21 of the tubular elements are appropriately crimped in a sealed manner in ad hoc openings made in the casing 1, as can be seen from FIG. 2; the manifolds 15, 16 are fastened at this level.

According to an essential characteristic of the invention, the casing 1 is made of plastic.

It is, for example, obtained by rotomolding or injection molding.

The casing is made of two half-shells which are heat-sealed together after the tubular bundle has been installed inside one of them.

The casing 1 is open on one of its sides, in this instance on the side situated on the left when considering FIG. 1.

During use of the appliance, a portion of the steam contained in the burnt gases condenses on contact with the walls of the tubes.

The reference 10 denotes the bottom wall of the enclosure; in a known manner, this bottom is inclined, thereby enabling the condensates to be discharged toward an outlet orifice 13.

The rear wall of the casing bears the reference 11; it has a recess 110 which, as will be seen later on, forms a channel through which the burnt gases and flue gases can pass, channeling them toward a discharge sleeve 12.

Of course, the orifice 13 is connected to a condensate discharge pipe, while the sleeve 12 is connected to a flue gas discharge pipe, for example a flue duct. These pipes and duct are not represented in the figures.

The open side of the casing is closed off by a facing element 3. The latter is fastened over the whole of its periphery by a rim 30 which is crimped in a gastight manner on a peripheral flange 14 bordering the entrance to the casing.

A seal, for example a silicone seal (not shown), may advantageously be provided at this level.

The facing plate 3, which is made of stainless steel for example, is normally closed off by a removable door 4.

In the embodiment represented, the door 4 is in two parts; it is composed of an external plate 40, made of heat-resistant plastic or metal, and of an internal plate 41 made of an insulating, for example ceramic-based, material.

These two plates are traversed in their central part by an opening which is traversed by a burner 6, for example a gas burner, which is secured to the door 4 by means which have not been shown.

Suitable means connected to the burner 6 make it possible for a gas and air (such as propane+air) fuel mixture to be fed to the appliance.

These means may consist in particular of a fan fastened to the door and capable of blowing the gas mixture into the burner, or of a flexible pipe connected to the door.

The burner 6 is a cylindrical tube with a closed end, the wall of which is perforated with a multitude of small holes which enable the fuel mixture to pass radially to the outside of the tube.

The outer surface of this wall constitutes the combustion surface. An ignition system (not shown) of known type containing a spark-generating electrode, for example, is of course associated with the burner.

The latter is situated coaxially with the center of the winding 2, but it does not extend over the whole length thereof.

In fact, the tubular bundle 2 is subdivided into two parts, one 2*a* situated to the left of a deflector 7, and the other 2*b* situated to the right thereof.

The deflector 7 is a disk made of a thermally insulating, for example ceramic-based, material; it is borne by a reinforcement in the form of a thin stainless steel plate 70 whose peripheral edge is inserted between two adjacent turns of the bundle.

The exchanger in question is a double exchanger, such as represented in FIG. 8 of the aforementioned European patent, which makes it possible to achieve excellent efficiency.

The part 2*b* of the bundle is responsible for preheating the fluid, which circulates from right to left when considering FIG. 1. The part 2*a* is responsible for the actual heating.

According to an essential characteristic of the invention, the turns of the tubular bundle 2 are firmly kept pressed against one another by means of a mechanical retaining system.

What is involved in this instance is a set of four ties 5 which are formed by stainless steel cylindrical rods and are associated with bearing elements for each of the two opposed ends of the bundle.

As can be seen from FIG. 2, the ties 5 are arranged at the four vertices of an imaginary isosceles trapezoid. On one side (to the right in FIGS. 1 and 3), their end 51 is fastened—for example by welding—to a discoid annular plate 30 made of stainless steel, in the center of which an opening 300 is made.

On the opposite side, which corresponds to the left in FIGS. 1 and 3, the ties 5 are fastened to the facing 3, to which reference has been made above.

On this side, the end portions of the ties 5 are threaded; they pass through suitable orifices made at the periphery of the facing plate 3.

Nuts 500 screwed onto these threaded portions 50 place the ties under tension so as to forcefully apply (from right to left) the plate 30 against the last turn of the bundle 2 and, correspondingly (in the opposite direction), the facing 3 against the first turn of this bundle.

The bundle 2 is thus axially compressed with force between the bearing elements 3 and 30.

It will be noted that the end portions 50 are relatively long; they protrude beyond the nuts 500 over a considerable length, as can be seen from FIG. 3.

The reason for this is that the portions 50 also have the function of centering and fastening the door 4 against the facing 3.

To this end, the plate 40 constituting the door, the diameter of which is greater than the diameter of the insulating part 41, is traversed by four holes by means of which the portions 50 can be engaged.

The fastening is performed by nuts 400, which are advantageously self-locking nuts, to reduce the risk of inadvertent loosening, in particular under the effect of vibrations.

An annular lip seal 42 housed in a suitable groove made in the plate 40 makes it possible to press the latter in a flue gas-tight manner against the external face of the facing 3.

As can be seen from FIG. 2, the ties 5 are arranged outside the bundle 2.

By observing FIG. 3, it will be made quite clear that the assembly formed by the facing 3, the ties 5 and the end bearing elements 3, 30 forms an independent assembly.

The expansions which tend to occur under the effect of the internal pressure prevailing in the tube of the winding 2 are countered by the ties and the bearing elements which fully absorb the axial thrust loads.

There is no transfer of this thrust against the wall of the casing containing this assembly.

The tubular bundle can be kept in place inside the casing simply as a result of the end parts of the tubes 20, 21 being fitted into the housings provided in the casing to receive them.

It will be noted furthermore, that a deflecting partition 8 is provided above the rear region of the winding 2, this partition partially overlapping the rear annular plate 30 down to its central opening 300.

This partition advantageously participates in correctly maintaining the bundle inside the casing.

It is fastened to the internal wall of the casing and extends obliquely below the sleeve 12. It preferably has an arcuate shape, having a contour forming an arc of a circle, surrounding the upper region of the bundle.

The hot gases generated by the burner 6 pass first through the first part 2*a* of the bundle 2 (situated to the left of the deflector 7), passing radially between the gaps of the tubes from the inside toward the outside.

By virtue of the presence of the partition 8, they are unable to escape immediately through the sleeve 12.

They must pass through the rear part 2*b* of the exchanger (situated to the right of the deflecting plate 7), this time from the outside toward the inside, preheating the water which circulates in the tubular bundle.

Finally, the cooled gases escape via the rear channel delimited by the wall 110, to rejoin the discharge sleeve 12.

The plastic constituting the casing is chosen to continuously withstand temperatures of around 150° to 160° C.

This is advantageously a composite material based on a glass-fiber-reinforced or glass-flake-reinforced resin.

A particularly suitable type of resin which may be mentioned is a compound of polyphenylene oxide, polystyrene and polypropylene, such a material being suitable for withstanding chemical attack by hot flue gases and by condensates.

The wall of the casing 1 may be relatively thin, for example between 2 and 4 mm thick, owing to the fact that it is not exposed to large mechanical stresses.

For maintenance purposes, access can be easily gained to the inside of the front part of the exchanger, this being the only part which is really exposed to soiling due to the flue gases; all that is required for this is to unscrew the nuts 400 and axially withdraw the assembly formed by the door 4 and the burner 6 fixed thereto.

After cleaning, it is just as easy to reinstall this assembly.

These disassembly and reassembly operations have no effect on the retaining function performed by the ties 5, which remain active in spite of the momentary removal of the door.

In a variant embodiment of this device, it would be possible to fasten the discoid deflector 7 to the end of the burner 6.

In that case, the door 4, the burner 6 and the deflector 7 would form an assembly which could be disassembled en bloc, which would make it possible to have access for cleaning purposes to the whole of the inner space of the winding, including the rear portion which performs the preheating.

Of course, assuming such a situation, it would be necessary to provide a highly heat-resistant annular seal all around the deflecting disk 7, this seal bearing against the inner surface of the bundle so as to prevent gases passing directly at this level toward the part 2*b*.

In the second embodiment of the invention, which is illustrated in FIGS. 5 to 7, a configuration analogous to that which has just been described is once more encountered, although the appliance has been turned around by 180° (facing situated to the right of FIG. 5).

The elements which are identical or similar to those of the first embodiment have been assigned the same reference numbers, and no explanation with regard to their nature and their function will be given again.

It will be noted that this exchanger has greater axial compactness than in the first embodiment.

As already stated, the rectilinear end portions of the tubes extend tangentially to the winding, their axes being contained in the same laterally arranged longitudinal plane (see FIG. 6).

Furthermore, on the opposite side to the facing 3, the ties 5 are fastened not to an annular plate 30 but to a pair of bent flat rods 30*a*, 30*b*, the central regions of which bear against an angular sector, having a relatively limited area, of the corresponding end turn.

As can be seen from FIG. 6, the ties are this time arranged in a square, and the bent rods 30*a*, 30*b* connect these sides in pairs, following as closely as possible two diametrically opposed regions of the winding.

It will be noted (see FIG. 5) that the partition 8 has a recess 80 situated above the tubular winding, in the vicinity of the tubes situated at the exit from the part 2*a* constituting the main exchanger.

A temperature probe 9 is mounted in this recess.

This probe is a thermal circuit breaker which is mounted sealably with respect to the casing. For this purpose, the probe 9 is advantageously kept in place by means of a circlip in a stainless steel cup fitted into the recess 80, which is open to the bottom, a suitable seal providing sealing between the cup and the wall of the recess 80.

This probe is connected to the burner control and is designed to cause the burner to shut down when the temperature detected exceeds a predetermined threshold, for example 160° C.

Abnormal overheating may occur accidentally, for example in the event of water being absent from the tubes or in the event of poor water circulation in the tubes, for example caused by a blockage of one of them.

In the absence of any safety measures, there might occur a very large rise in the temperature of the flue gases leaving the tubes placed around the burner and coming into contact with the inside of the plastic casing. What would happen is that the flue gases would no longer transmit their heat sufficiently to the tubes.

There might then be a problem in terms of the mechanical stability of the plastic and serious damage to the casing, with the latter even catching fire.

In the variant illustrated in FIG. 8, the probe, referenced 9', contains a heat-sensitive fusible element 92'.

The electric power circuit supplying the boiler is connected up to two terminals 90' and 91' which are connected via this heat-fusible element 92'.

In the event of an abnormal rise in the temperature, for example beyond 160° C., this element 92' melts and breaks the electrical circuit between the two terminals 91', 90', causing the burner control to be shut down.

FIG. 9 illustrates the circulation of the hot gases generated by the burner 6, the latter being supplied with combustible mixture G+A.

After it has been ignited, the burner generates burning gases, for example at a temperature of 1000° C., which propagates radially outward as symbolized by the arrows $F_1$.

These burning gases pass radially through the gaps in the first part of the exchanger 2*a* from the inside toward the outside (arrows $F_2$).

During this passage, a large portion of the heat of the burning gases is transmitted via the wall of the tubes to the water circulating therein, with the result that the temperature of the hot gases leaving the bundle part 2*b* is, by way of illustration, around 110 to 140° C.

It will be noted that the presence of the deflector 6 prevents the burning gases $F_1$ from escaping axially.

The partially cooled gases then pass through the second part 2*b* of the exchanger, this time from the outside toward the inside, as symbolized by the arrows $F_3$.

An additional portion of the heat is thus transmitted to the water circulating in the tubes. The temperature of the gases escaping from the appliance (arrows $F_4$ and $F_5$) is, by way of illustration, around 65 to 70° C.

With regard to the water, it is generally heated up from the ambient temperature to a temperature of around 80° C.

Of course, the water flows in the opposite direction to the flow of the flue gases, preheating taking place in the region 2*b* of the exchanger and the actual heating in the region 2*a*.

In the embodiment which is represented in FIGS. 10 to 12, the exchanger is not provided with a burner.

The casing contains an intake sleeve E for the hot gases, these coming from an external source.

This sleeve emerges on the inside of the winding of tubes 2.

This involves an arrangement which is analogous to that forming the subject of FIG. 19 of the aforementioned European patent.

The same reference numbers have been used to denote elements which are identical to those of the first embodiment, indexed with a prime as appropriate when the elements are similar but not identical.

A single exchanger (without preheating) is involved in this case.

The hot gases which enter the interior enclosure of the casing, via the sleeve E, escape radially from the inside toward the outside of the tubular bundle 2, heating up the fluid which circulates therein; the cooled gases escape through the sleeve 12.

The tubular elements constituting the winding may be arranged in parallel, the inlet and outlet manifolds 15' and 16' respectively providing for their collection and distribution either at the entrance to or at the exit from the tubes.

The casing 1' is made of plastic.

The means for mechanically retaining the bundle are similar to those of the first embodiment.

They comprise a set of four ties which are fastened at their ends, for example by welding, to two plates 30, 3'.

The plate 30 situated on the intake sleeve E side is a disk whose center has an opening 300 in register with the gas inlet passage delimited by the sleeve E.

The bottom plate 3' is a disk which has not been provided with a cutout.

This disk closes off the rear part of the winding, forcing all of the hot gases to leave through the gaps between the turns.

To prevent the casing bottom wall situated facing the plate 3', which is exposed to the hot gases, a clearance j is provided between these two elements.

Of course, this appliance may also be equipped with a temperature probe designed to stop hot gases being admitted when the probe detects a predetermined excessive temperature.

Returning to the first two embodiments, it should be noted that the burner employed does not necessarily have to have a cylindrical shape; it could have a flat or hemispherical shape while still remaining fixed to the door.

The weight saving obtained by using a plastic casing is around 20% with respect to a similar appliance having the same performance but whose casing is made of metal.

The exchanger variant illustrated in FIGS. 13 and 14 is similar, in its structure, to that already described with reference to FIGS. 5 to 7, which is why this structure will not be described again here.

However, as will be explained, it contains a shroud which performs the function of a heat shield.

Specifically, the annular part of the wall of the casing 1 which surrounds the winding 2 is equipped internally with a shroud 100. The latter is made of thin stainless steel sheet, the thickness of which is around 0.3 to 0.4 mm, for example.

Figure 15:
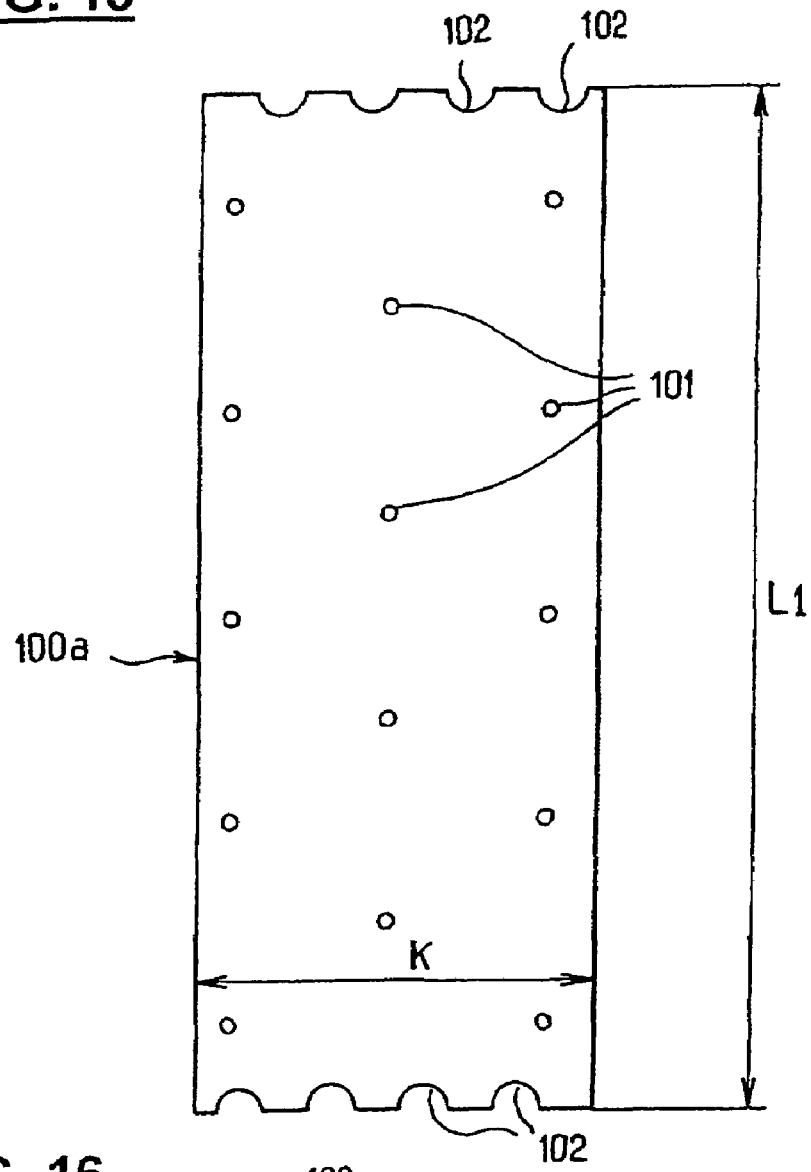
Figure 16:
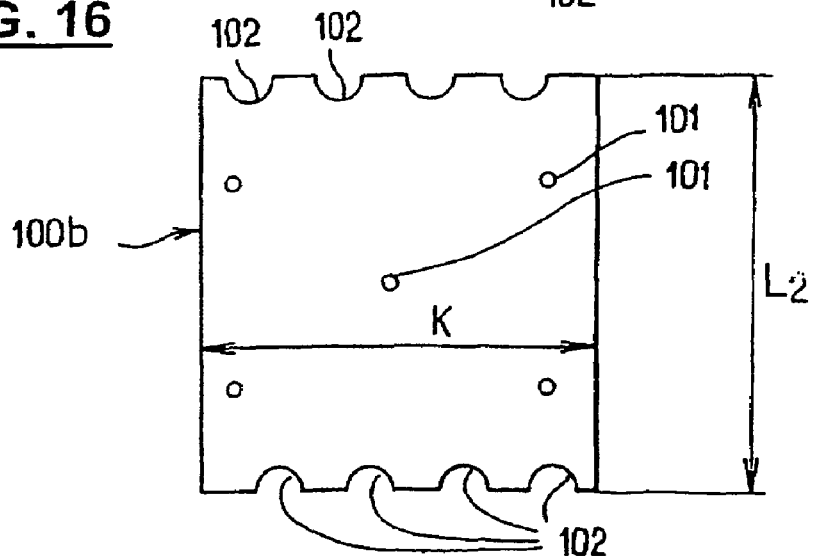

This shroud bears against the internal face of the casing, with a certain spacing j (see FIG. 13), of around 2 mm for example. This separation is provided by means of a plurality of bearing studs 101 consisting of cups of small size stamped into the sheet so as to form bosses projecting to the outside of the shroud. As shown by FIGS. 15 and 16, which represent a developed view of the sheet in two parts constituting the shroud, these bosses 101 have a uniform geometric distribution in the surface of the sheet, being arranged in this instance as equal equilateral triangles.

The spacing j and the presence of the bosses 101, which bear against the casing 1 by way of regions of very small area, which are virtually point regions, makes it possible to considerably reduce the transmission of the heat absorbed by the shroud 100 to the wall surrounding it.

At its ends, this shroud bears, on the front side, against the facing 3, and, on the other side, against the partitions 8-8'.

Its axial length, which corresponds substantially to that of the winding 2, is referenced K in FIG. 13.

In the embodiment illustrated, the shroud 100 is formed by two initially flat, separate parts, which are represented in FIGS. 15 and 16 and referenced 100*a* and 100*b* respectively.

These are strips of stainless steel sheet of width K and of length $L_1$ and $L_2$ respectively.

On its longitudinal edges, each of the strips 100*a*, 100*b* has a series of four notches 102 having a substantially semicircular or semioval shape which is complementary with the shape of the cross section of the end portions of the tubes at the level of the wall 1 which they pass through.

The length $L_1$ of the strip 100*a* is significantly greater than that $L_2$ of the strip 100*b*.

The sum $L_1+L_2$ corresponds approximately (allowing for the spacing j) to the circumference of the internal wall of the casing 1 against which the strips 100*a* and 100*b* are pressed after they have been rounded to adapt to the curvature of the wall of the casing 1. As can be seen from FIG. 14, this casing has a cross section whose contour is halfway between a circle and a square with rounded corners.

The short element 100*b* is placed on that side where the mouths 20', 21' of the tubes are situated, outside these mouths (to the left in FIG. 14), while the long element 100*a* is placed on the other side.

They are brought together by way of their longitudinal edges (parallel to X-X') and tightly enclose the end portions, or mouths, of the tubes constituting the winding 2 with a slight clearance by way of their notches 102, which are suitably configured and positioned for this purpose.

As a result of their elasticity, the two strips of sheet are pressed closely, by way of their bosses 101, against the internal face of the casing without having to make use of specific fastening means. They thus form a shroud which, in a relatively sealed manner, insulates said internal face of the casing from the hot gases circulating in the exchanger, performing the function of a heat shield or isothermal shield.

If, as in the embodiment illustrated in FIG. 13, the wall of the casing 1 has an inwardly pointing recess 80, which houses a temperature probe 9, it goes without saying that the shroud is traversed in this region by a suitable opening into which the recessed wall portion is inserted. In this region, the wall of the casing, which is not protected thermally, is therefore exposed to a temperature which is higher than that of the remainder of the wall, which is protected by the shroud.

In practice, this does not present any difficulties since this region has a very limited area, and the excess heat arising there is evacuated by thermal transfer toward the neighboring wall zone, which is less hot.

The presence of the shroud has the effect of lowering the temperature to which the wall of the casing is exposed by a value of around 15 to 20° C., which makes it possible to use a less noble, and consequently less expensive, plastic than that which can be used with the previously described embodiments (not provided with a shroud), and/or to improve the stability over time and also the durability thereof.

The invention claimed is:

1. A condensation heat exchanger associated with a gas or fuel burner, which comprises:

at least one bundle of tubes, wherein the bundle includes one tube, or a group of tubes arranged end to end, forming a helical winding, in which the wall of the tube or tubes is made of a highly thermally conductive material and has a flattened oval cross section, wherein the major axis of the cross section is perpendicular, or approximately perpendicular, to that of the helix, while the width of a gap separating two adjacent turns is constant and appreciably smaller than the thickness of said cross section, a fluid heated up, in particular cold water, for circulating inside the tube or tubes constituting said bundle; and a gas-impermeable casing, wherein the bundle is fixedly mounted inside the gas-impermeable casing, the casing having a sleeve for the discharge of the burnt gases, wherein the exchanger is arranged such that the hot gases generated by the burner pass radially, or approximately radially, through said bundle via the gaps separating turns of the bundle, wherein said casing is made of heat-resistant plastic, wherein the casing contains retaining devices for mechanically retaining said bundle in an axial direction of the bundle, these retaining devices being able to absorb thrust loads resulting from the internal pressure of the fluid which circulates therein and which tends to deform the walls thereof, while preventing these loads from being transmitted to the casing, and wherein said retaining devices comprise a set of ties which extend outside the bundle, parallel to the axis of the helix, and whose ends are fixed to bearing elements pressing against the two opposed faces of the bundle.

2. The exchanger as claimed in claim 1, further comprising a temperature probe borne by said casing which is able to shut down the burner when the temperature prevailing inside the casing exceeds a predetermined threshold.

3. The exchanger as claimed in claim 1, wherein the bearing element situated at one of the ends of the set of ties is a thin plate, wherein the plate includes a cut out in a central part of the plate and the plate has an annular shape.

4. The exchanger as claimed in claim 3, wherein said plate serves as a facing which partially closes off an open face of the casing and is fastened to the latter at a periphery of the casing.

5. The exchanger as claimed in claim 4, wherein end portions of the ties pass through said facing in such a way as to project slightly outward, and in that the end portions are threaded such that the end portions allow a door to be removably mounted against the facing by means of nuts.

6. The exchanger as claimed in claim 5, wherein said door is fixed to the burner.

7. The exchanger as claimed in claim 4, further comprising four ties arranged substantially in a square, and in that the bearing elements situated on the opposite side to said facing include a pair of arcuate or bent straps configured to follow the contour of the bundle as closely as possible and pressing against two diametrically opposed regions thereof, each strap being fastened to a pair of neighboring ties.

8. The exchanger as claimed in claim 1, wherein the casing is composing of a plastic that is a composite material based on glass-fiber-reinforced or glass-flake-reinforced resin.

9. The exchanger as claimed in claim 8, wherein said resin is a compound of polyphenylene oxide, polystyrene and polypropylene.

10. The exchanger as claimed in claim 1, wherein the bundle includes two bundles of coaxial tubes situated end to end and connected to one another, one of which serves as a primary exchanger and the other as a secondary exchanger, and further comprising a deflecting member being sandwiched between the two bundles and thus arranged such that the hot gases generated by the burner pass first through the primary exchanger, passing through gaps separating turns of the bundle from the inside to the outside of the bundle, and then through the secondary exchanger, passing through gaps separating turns of the bundle from the outside to the inside, after which the hot gas is discharged via said sleeve.

11. The exchanger as claimed in claim 10, wherein said deflector is fixed to said bundles of tubes.

12. The exchanger as claimed in claim 10, wherein the burner is mounted inside said bundle serving as the primary exchanger, wherein said deflector has a discoid shape and is fixed to the end of the burner, and the deflector is equipped at a periphery of the deflector with a thermally insulating seal that presses against the inside of the bundle.

13. The exchanger as claimed in claim 1, wherein said casing is composed of two molded half-shells brought together and secured to one another.

14. The exchanger as claimed in claim 1, further comprising a shroud arranged outside said bundle and inside said plastic casing, wherein the shroud acts as a heat shield, and wherein the shroud is capable of insulating the casing from heat emitted by the burnt gases.

15. The exchanger as claimed in claim 14, wherein said shroud is made from thin stainless steel sheet.

16. The exchanger as claimed in claim 14, wherein said shroud is applied to the internal surface of said plastic casing so that the shroud is spaced a certain distance from the plastic casing.

17. The exchanger as claimed in claim 16, wherein said shroud is spaced a certain distance from the plastic casing by a series of bosses stamped into a wall of the shroud.

18. The exchanger as claimed in claim 14, wherein said shroud includes two complementary rounded parts brought together so as to form an annular casing fitting against the internal surface of said plastic casing.

19. The exchanger as claimed in claim 18, wherein mutually facing edges of the rounded parts have a row of approximately semicircular or semioval notches which are able to tightly enclose the rectilinear end portions of the tube or tubes constituting the winding when these rounded parts are brought together.

* * * * *